US006239827B1

(12) United States Patent
Minagawa

(10) Patent No.: US 6,239,827 B1
(45) Date of Patent: May 29, 2001

(54) THERMOELECTRIC PRINTER

(75) Inventor: Hiroshi Minagawa, Yamagata (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/208,845

(22) Filed: Dec. 10, 1998

(30) Foreign Application Priority Data

Dec. 10, 1997 (JP) ..... 9-361835

(51) Int. Cl.[7] ..... B41J 17/00
(52) U.S. Cl. ..... 347/215; 347/219
(58) Field of Search ..... 400/234, 249; 347/197, 217, 219, 215

(56) References Cited

U.S. PATENT DOCUMENTS 4,775,869 * 10/1988 Minowa ..... 347/197
5,168,286 * 12/1992 Okauchi et al. ..... 347/222

FOREIGN PATENT DOCUMENTS 2-31756 2/1990 (JP) .
5-58386 8/1993 (JP) .
5-309901 11/1993 (JP) .
9-169147 6/1997 (JP) .

* cited by examiner

*Primary Examiner*—N. Le
*Assistant Examiner*—K. Feggins
(74) *Attorney, Agent, or Firm*—Foley & Lardner

(57) ABSTRACT

A thermoelectric printer which does not cause paper and an ink coated film stains or creases, regardless of the sizes of a take-up diameter taken up the ink coated film is provided. At the thermoelectric printer which a ink coated film is taken up by a take-up shaft generating fixed rotating torque and said ink coated film is driven with friction by rotating torque of a film driving roller in one carrying route, paper is driven by paper driving rollers in the other carrying route, said ink coated film and said paper carried by said carrying routes are carried to the place between a thermal head and a platen, and pressed and thermoelectrically printed, a take-up diameter detecting mechanism detects the sizes of the take-up diameter of the ink coated film and rotating torque of the film driving roller is controlled corresponding to the take-up diameter detected the take-up diameter of the ink coated film and feed power applying to the ink coated film under taken up is set to be suitable and the paper and the ink coated film are not able to be stained and creased.

18 Claims, 5 Drawing Sheets

THERMOELECTRIC PRINTER

BACKGROUND OF THE INVENTION

The present invention relates to a thermoelectric printer which in particular is able to implement a high quality thermoelectric printing, regardless of the sizes of a take-up diameter of the ink coated film used for thermoelectric printing and taken up by a take-up shaft.

Description of the Related Art

For example, for prints, such as large size price tags at a supermarket, a thermoelectric printer is used. This thermoelectric printer is able to print on rather large size papers in clear, by a simple way and in short time.

FIG. 1 is a perspective diagram of a main part of an ink coated film feeding mechanism 100 of the conventional thermoelectric printer. As shown in FIG. 1, over a rectangular plate type thermal head 101, a platen 103 which presses and transfers ink on an ink coated flm 102 to a paper 107 is disposed. The ink coated film 102 is taken up by a take-up shaft 104 rotating in a fixed torque to the counterclockwise direction. Between the take-up shaft 104 and the thermal head 101, a ribbon feed roller 105 which drives the ink coated film 102 with friction by the same fixed torque of the take-up shaft 104 to the counterclockwise direction and gives the ink coated film 102 tension and carries the ink coated film 102 to the direction of an arrow $X_1$ is disposed. At the below right of the thermal head 101, a ribbon brake roller 106 which gives the ink coated film 102 a certain brake to give tension to the ink coated film 102 is disposed.

At the upper left of the thermal head 101, a first paper feed roller 108 constituted of a pair of rollers which carries the paper 107 in putting between the rollers by friction to the direction of an arrow $X_2$ in a fixed speed is disposed. At the upper right of the thermal head 101, a second paper feed roller 109 constituted of a pair of rollers which carries the paper 107 in putting between the rollers by friction to the direction of an arrow $X_2$ in a fixed speed and works together with the first paper feed roller 108 is disposed. By the rotating control of a motor of a controller, this motor is not shown in FIG. 1, the take-up shaft 104, above mentioned rollers 105, 106, 108 and 109 are rotated, and the ink coated film 102 is carried to the direction $X_1$ and the paper 107 is carried to the direction $X_2$. While this carrying process, the ink coated film 102 and the paper 107 are pressed between the thermal head 101 and the platen 103 and the ink coated on the ink coated film 102 is transferred to the paper 107 by the thermoelectric printing. In this case, it is a premise that the ink coated film 102 and the paper 107 are carried on the thermal head 101 by the same feed torque.

In the conventional ink coated film feeding mechanism, the ink coated film 102 is taken up by the take-up shaft 104 with a fixed torque. However, the take-up diameter between the beginning and the ending of the take-up shaft 104 is different, therefore the feed torque applying to the ink coated film under taken up changes.

At this, the following formula (1) is formed in the relation among the feed power F applying to the ink coated film under taken up, the rotating torque T of the take-up shaft, the take-up diameter D increasing by the taking up of the ink coated film, the friction coefficient $\mu$ between the ribbon feed roller and the ink coated film, and the power P which the ribbon feed roller presses and touches the ink coated film.

$$F=(2T/D)+\mu P \quad (1)$$

FIG. 2 is a graph showing the relation between the take-up diameter D and the feed power F. The unit of the take-up diameter D is mm and the unit of the feed power F is gram. As shown in FIG. 2, at the beginning of the take-up, the take-up diameter is small and the feed power is large, the tension of the ink coated film on the thermal head becomes too large and the problem that creases are formed on the ink coated film occurs.

On the contrary, at the ending of the take-up, the feed power F applying to the ink coated film becomes small, at the time when the paper is putted on the ink coated film on the thermal head, the slip between the paper and the ink coated film occurs, and the paper is stained by unnecessary ink and the thermal head is stained too, these problems occur. To solve these problems caused by the change of the feed power, as shown in FIG. 1, the conventional thermoelectric printer provides a clutch means 110 between the ribbon feed roller 105 and a roller rotating driving means which drives the ribbon feed roller 105, this roller rotating driving means is not shown in FIG. 1. This clutch means 110 is constituted of a first clutch plate 110*a* joining to the ribbon feed roller 105 by gears and a second clutch plate 110*b* glued a slipping material 110*c*. In this, this slipping material 110*c* is made of synthetic resin with special surface treatment. The second clutch plate 110*b* is directly joined to the roller rotating driving means which is not shown in FIG. 1.

As mentioned above, the take-up shaft 104 and the ribbon feed roller 105 are rotating by a fixed torque respectively, however at the case that the feed power under taken up is large, the clutch means 110 slips the ribbon feed roller 105 and the rotating torque of the roller rotating driving means is not transferred and prevents creases from occurring. On the contrary, the feed power under taken up is small, the clutch means 110 transfers the rotating torque of the roller rotating driving means to the ribbon feed roller 105 and makes the ink coated film have tension and the occurrence of the stain is prevented.

However, in the above mentioned feed power changing solution using the special slipping material, the value starting slip has a variation, the problem of the stain and creases is not solved completely.

SUMMARY OF THE INVENTION

It is therefore an object of the present invention to provide a thermoelectric printer in which paper and an ink coated film are not stained and creased regardless of the size of a take-up shaft taken up ink coated film.

To solve the above mentioned problems, the present invention provides at a thermoelectric printer which a ink coated film is taken up by a take-up shaft generating fixed rotating torque and said ink coated film is driven with friction by rotating torque of a film driving roller in one carrying route, paper is driven by paper driving rollers in the other carrying route, said ink coated film and said paper carried by said carrying routes are carried to the place between a thermal head and a platen, and said ink coated film and said paper are pressed and said paper is thermoelectrically printed, a take-up diameter detecting means for detecting the take-up diameter of the ink coated film taken up by said take-up shaft and a rotating torque control means for controlling the rotating torque of said film driving roller corresponding to the take-up diameter detected by said takeup diameter detecting means.

With this construction, the take-up diameter of the ink coated film is detected by the take-up diameter detecting means, the rotating torque of the film driving roller is controlled by the rotating torque control means corresponding to the sizes of the take-up diameter, the feed power applying to the ink coated film under taken up is able to be a suitable value, therefore at the place between the thermal head and the platen the ink coated film and the paper are able to be pressed by the same feed power and the paper is thermoelectrically printed and is not stained and creased.

BRIEF DESCRIPTION OF THE DRAWINGS

The objects and features of the present invention will become more apparent from the consideration of the following detailed description taken in conjunction with the accompanying drawings in which.

DESCRIPTION OF THE PREFERRED EMBODIMENTS

Figure 1:
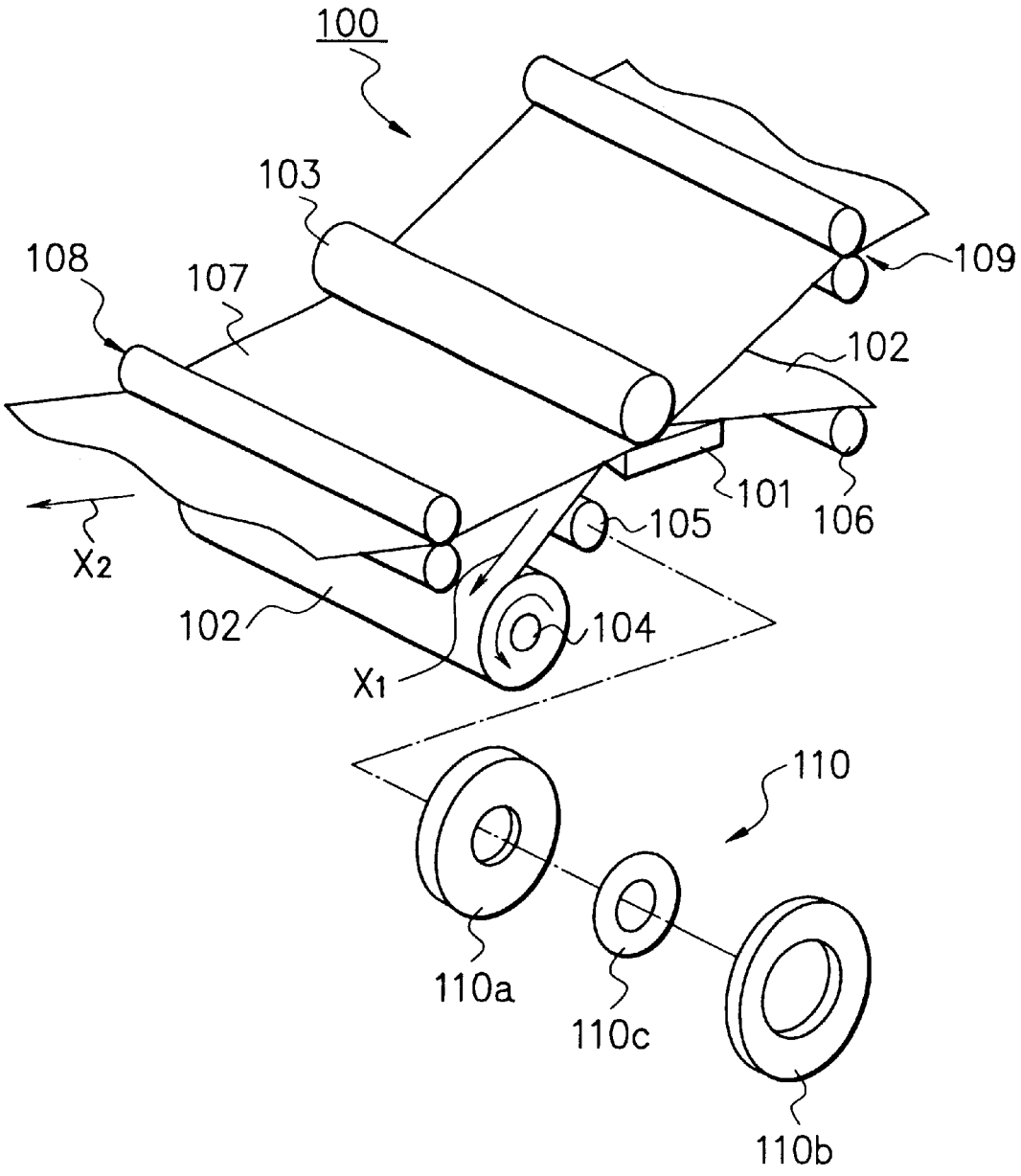
FIG. 1 PRIOR ART
FIG. 1 is a perspective diagram of a main part of an ink coated film feeding mechanism of the conventional thermoelectric printer.
Figure 2:
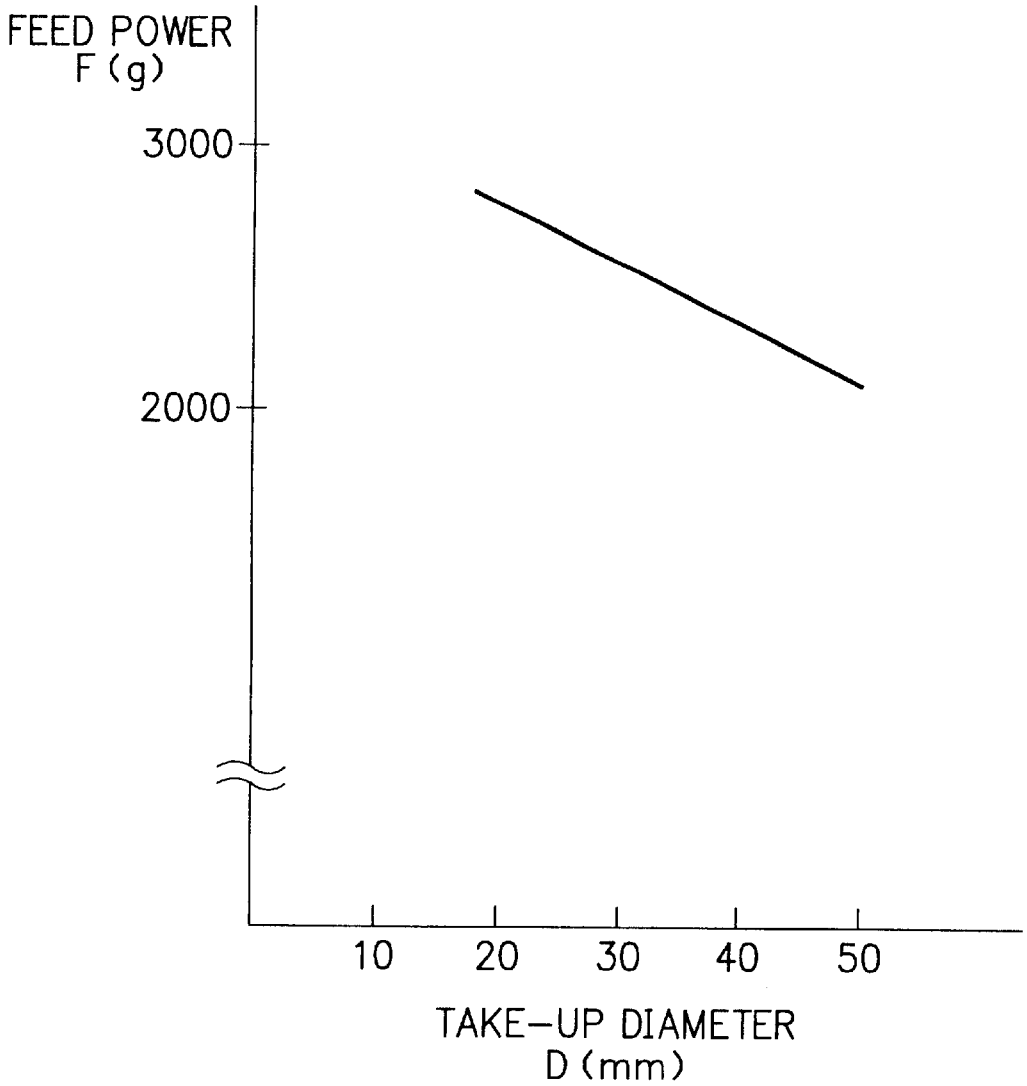
FIG. 2 PRIOR ART
FIG. 2 is a graph showing the relation between a take-up diameter and feed power of the conventional type.
Figure 3:
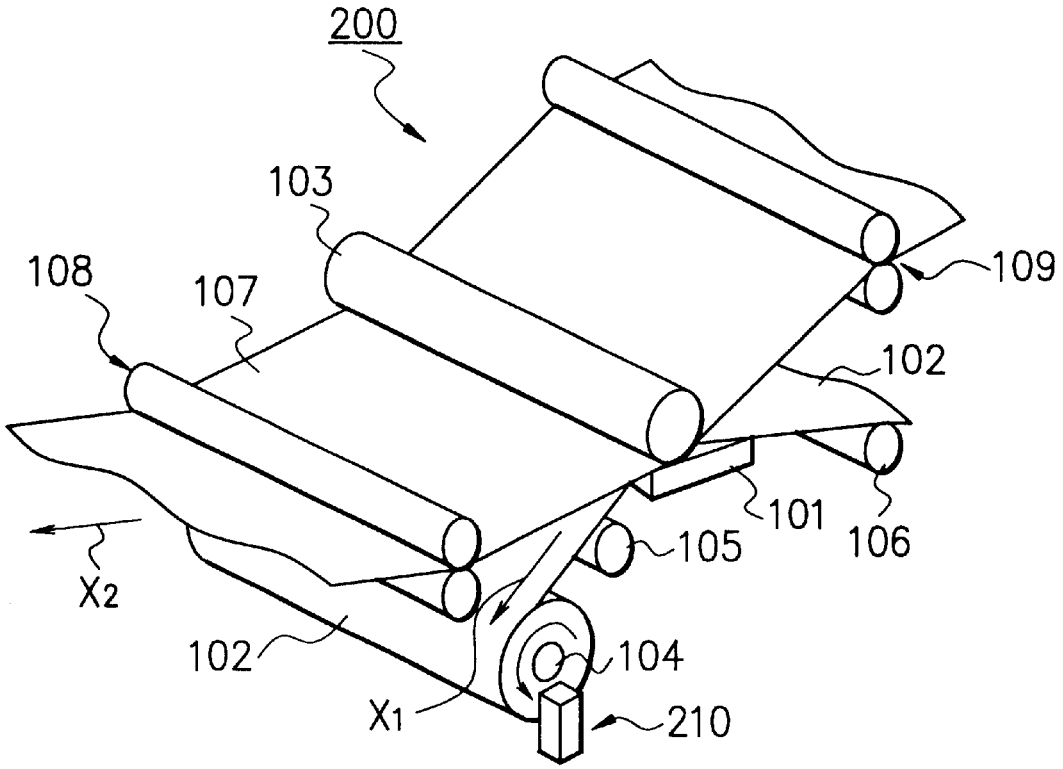
FIG. 3 is a perspective diagram of a main part of an ink coated film feeding mechanism of the thermoelectric printer of the present invention.
Figure 4:
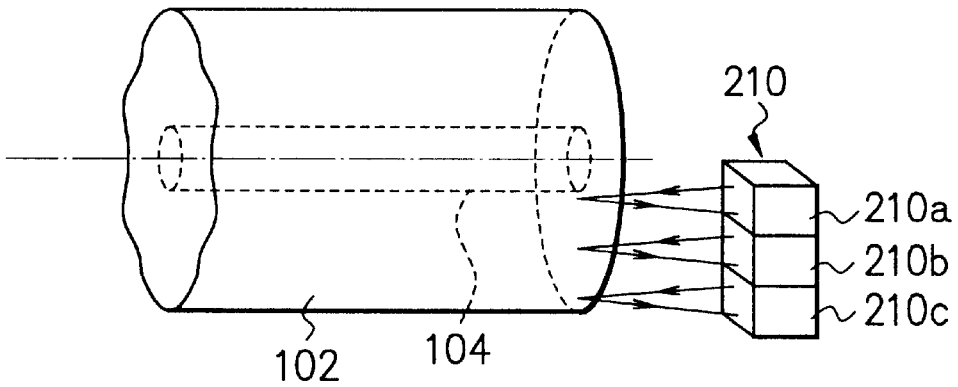
FIG. 4 is an expanded diagram of a part of an ink coated film feeding mechanism of the thermoelectric printer of the present invention.
Figure 5:
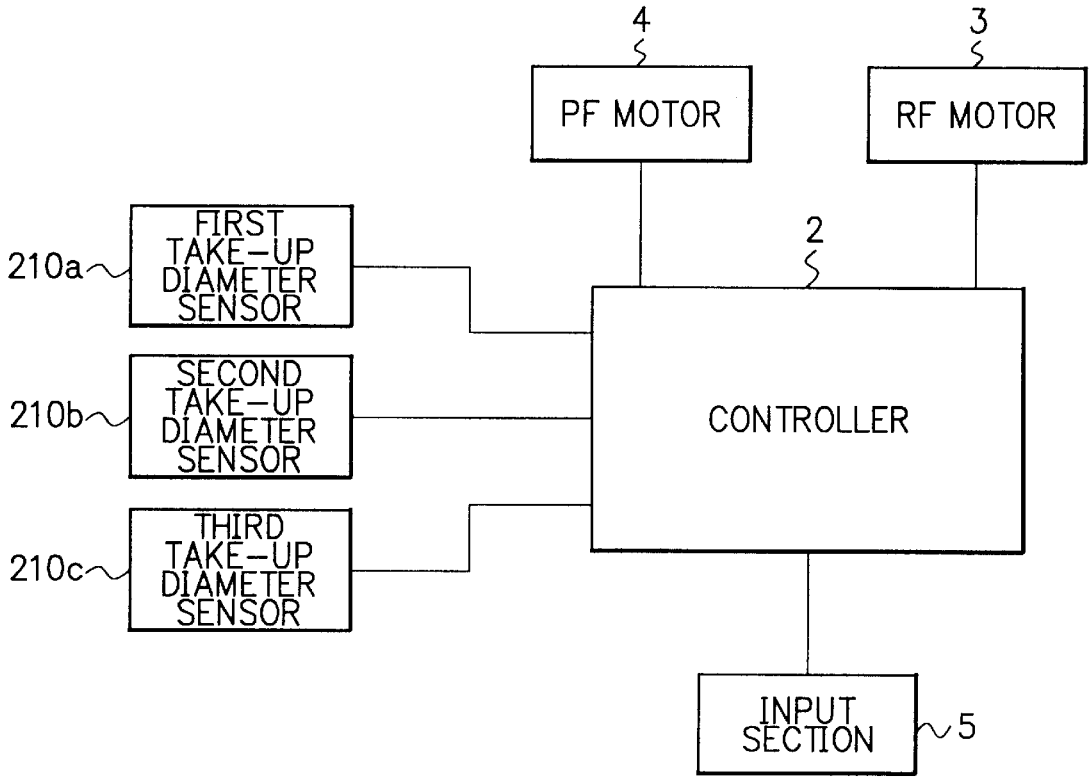
FIG. 5 is a block diagram of an example of a control section of the present invention.

Referring now to the drawings, embodiments of the present invention are explained in detail. The same sign numbers explained in the conventional type are used in the present invention and the explanation of the same functions in the conventional type is omitted in the present invention. FIG. 3 is a perspective diagram of a main part of an ink coated film feeding mechanism 200 of a thermoelectric printer of the present invention. FIG. 4 is an expanded diagram of a part of an ink coated film feeding mechanism of the thermoelectric printer of the present invention and FIG. 5 is a block diagram of an example of a control section of the thermoelectric printer of the present invention.

As shown in FIGS. 3 and 4, on the side of a take-up shaft 104 a take-up diameter sensor block 210 detecting the size of the take-up diameter of an ink coated film 102 is disposed. The take-up diameter sensor block 210 is a reflection type sensor and is constituted of a first take-up diameter sensor 210*a* which lightens slightly the outside of a take-up shaft 104 and detects the size, a second take-up diameter sensor 210*b* which lightens nearly the center of the maximum take-up diameter of the ink coated film 102 and detects the size and a third take-up diameter sensor 210*c* which lightens slightly the inside of the maximum take-up diameter of the ink coated film 102 and detects the size. In this embodiment, the take-up diameter sensor block 210 is constituted of three sensors, however the number of sensors used in the take-up diameter sensor block is not limited to three, four or more sensors are applicable.

Next, a control section is explained. As shown in FIG. 5, a controller 2 constituted of CPU and so forth is connected to the first take-up diameter sensor 210*a*, the second take-up diameter sensor 210*b* and the third take-up diameter sensor 210*c* and is also connected to a ribbon feed RF motor 3 which drives a ribbon feed roller 105 and is a variable torque motor and a paper feed PF motor 4 which drives a first paper feed roller 108 and is a stepping motor. As the variable torque RF motor 3, for example a torque motor which can vary torque by changing voltage is desirable.

The operation of an example of an embodiment is explained. First, the ink coated film 102 and paper 107 are inserted to fixed positions and an instruction is inputted from an input section 5 and tension is given to the ink coated film 102 between a ribbon feed roller 105 and a ribbon brake roller 106, and sag of the ink coated film 102 is removed and the fixed tension is given to the ink coated film 102. And then the take-up of the ink coated film 102 is started. The take-up diameter sensor block 210 detects the size of the take-up diameter of the ink coated film 102. At the case that only the first take-up diameter sensor 210*a* detects the ink coated film 102, the taken up quantity is small and the feed power is large, therefore to make the rotating torque of the ribbon feed roller 105 small, the controller 2 directs the RF motor 3 to make the rotating torque small.

As the same as above, at the case that both the first take-up diameter sensor 210*a* and the second take-up diameter sensor 210*b* detect the ink coated film 102, the take-up quantity is in the middle and the feed power is also in the middle, therefore, the controller 2 directs the RF motor 3 to make the rotating torque of the ribbon feed roller 105 middle. And at the case that all the first, second and third take-up diameter sensor 210*a*, 210*b* and 210*c* detect the ink coated film 102, the taken up quantity is nearly the maximum quantity and the feed power is small, therefore, the controller 2 directs the RF motor 3 to make the rotating torque of the ribbon feed roller 105 large.

As mentioned in the conventional type, the before mentioned formula (1) also exists between the feed power F applying to the ink coated film under taken up and the take-up diameter D of the ink coated film in the present invention. This formula is shown below, each sign is the same as the conventional type, therefore the definition of each sign is omitted.

$$F=(2T/D)+\mu P \tag{1}$$

Figure 6:
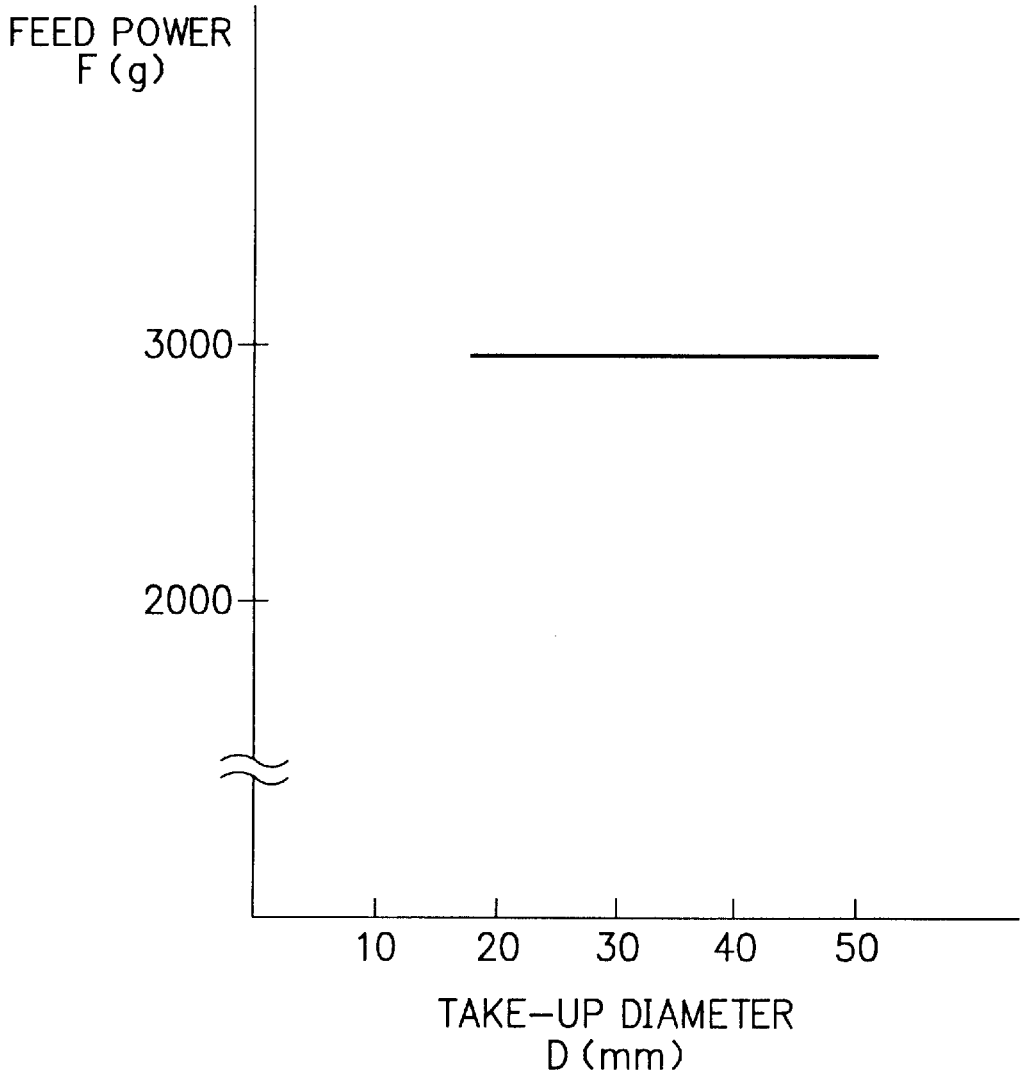
FIG. 6 is a graph showing the relation between a take-up diameter and feed power of the present invention.

As shown in FIG. 6, the characteristic between the take-up diameter D and the feed power F at the case that the rotating torque of the ribbon feed roller 105 is controlled by the corresponding take-up diameter of the ink coated film 102 according to the present invention is shown. Regardless of the sizes of the take-up diameter of the ink coated film 102, the feed power F applying to the ink coated film 102 under taken up is able to be constant value. The controller 2 instructs the PF motor 4 to make the first paper feed roller 108 rotate in a fixed speed.

For example, at the case that only the first take-up sensor 210*a* detects the take-up diameter D of the ink coated film 102, the take-up diameter D is small and the feed power F is large, therefore small torque is generated by the RF motor 3. Then, the paper 107 and the ink coated film 102 are fed to the place between the thermal head 101 and the platen 103 by the same feed power F and pressed by the fixed power and the ink is transferred by the thermoelectric print. In this case, the same feed power F is applied for both the paper 107 and the ink coated film 102 and the thermoelectric printing is implemented, therefore the paper 107 is not stained and creased. And the printed paper 107 is sent out to the outside and the ink coated film is taken up to a take-up device, this take-up device is not shown in FIG. 3.

The same as above, even at the case that the take-up diameter is at the middle position or the nearly maximum position, the feed power F is controlled corresponding to the take-up diameter D as mentioned above, therefore the thermoelectric printing is implemented to the paper 107 and the ink coated film 102 by the same feed power F and the paper 107 is not stained and creased.

As explained above, according to the present invention, the take-up diameter is detected by a take-up diameter detecting means, the rotating torque of the film driving rollers is controlled by a rotating torque control means corresponding to the sizes of the take-up diameter and the feed power applying to the ink coated film under taken up is to be set as a suitable value, therefore at the place between the thermal head and the platen, the thermoelectric printing of the ink coated film and the paper is able to be implemented by the same feed power and the paper is not stained and creased.

While the present invention has been described with reference to the particular illustrative embodiments, it is not to be restricted by those embodiments but only by the appended claims. It is to be appreciated that those skilled in the art can change or modify the embodiments without departing from the scope and spirit of the present invention.

What is claimed is:

1. A thermoelectric printer, comprising:

a take-up shaft adapted to take up an ink coated film and to generate a fixed rotating torque, a film driving roller in a first carrying route, paper driving rollers adapted to drive paper in a second carrying route, the ink coated film and the paper being carried to a place between a thermal head and a platen, the ink coated film and the paper being pressed, and the paper being thermoelectrically printed;

a take-up diameter detecting means for detecting a take-up diameter of the ink coated film taken up by said take-up shaft, said take-up diameter detecting means disposed opposite an end face of the ink coated film taken up in layers by said take-up shaft; and a rotating torque control means for controlling a rotating torque of said film driving roller corresponding to the take-up diameter detected by said take-up diameter detecting means.

2. A thermoelectric printer in accordance with claim 1, wherein:

said rotating torque control means controls feed power being applied to the ink coated film taken up to said take-up shaft.

3. A thermoelectric printer in accordance with claim 1, wherein:

said take-up diameter detecting means comprises reflection type sensors.

4. A thermoelectric printer in accordance with claim 3, wherein:

said take-up diameter detecting means detects the end face of the ink coated film taken up in layers in increments, the increments corresponding to respective locations of said reflection type sensors.

5. A thermoelectric printer in accordance with claim 4, wherein:

said take-up diameter detecting means detects a near place of a maximum take-up radius, a center place of the maximum take-up radius, and a near place of said take-up shaft from the outside, in turn, in the radial direction of the take-up diameter of the ink coated film.

6. A thermoelectric printer in accordance with claim 4, wherein:

said take-up diameter detecting means detects taken up sizes of the ink coated film at four or more places in the radial direction of the take-up diameter of the ink coated film.

7. A thermoelectric printer in accordance with claim 3, wherein:

said take-up diameter detecting means detects a near place of a maximum take-up radius, a center place of the maximum take-up radius, and a near place of said take-up shaft from the outside, in turn, in the radial direction of the take-up diameter of the ink coated film.

8. A thermoelectric printer in accordance with claim 3, wherein:

said take-up diameter detecting means detects taken up sizes of the ink coated film at four or more places in the radial direction of the take-up diameter of the ink coated film.

9. A thermoelectric printer in accordance with claim 1, wherein:

said take-up shaft takes up the ink coated film to a maximum take-up radius, and said take-up diameter detecting means detects the presence of the ink coated film in at least three places between an outside of said take-up shaft and the maximum take-up radius of the ink coated film in a radial direction.

10. A thermoelectric printer, comprising:

a take-up shaft adapted to take up an ink coated film and to generate a fixed rotating torque, a film driving roller adapted to drive paper in a first carrying route, paper driving rollers adapted to drive paper in a second carrying route, said ink coated film and said paper being carried to a place between a thermal head and a platen, said ink coated film and said paper being pressed, and said paper being thermoelectrically printed;

a take-up diameter detector to detect a take-up diameter of the ink coated film taken up by said take-up shaft, said take-up diameter detector disposed opposite an end face of the ink coated film taken up in layers by said take-up shaft; and a rotating torque control device to control a rotating torque of said film driving roller corresponding to the take-up diameter detected by said take-up diameter detector.

11. A thermoelectric printer in accordance with claim 10, wherein:

said rotating torque control device controls feed power being applied to the ink coated film being taken up to said take-up shaft.

12. A thermoelectric printer in accordance with claim 10, wherein:

said take-up diameter detector comprises reflection type sensors.

13. A thermoelectric printer in accordance with claim 11, wherein:

said take-up diameter detector detects the end face of the ink coated film taken up in layers in increments, the increments corresponding to respective locations of said reflection type sensors.

14. A thermoelectric printer in accordance with claim 13, wherein:

said take-up diameter detecting means detects a near place of a maximum take-up radius, a center place of the maximum take-up radius, and a near place of said take-up shaft from the outside, in turn, in the radial direction of the take-up diameter of the ink coated film.

15. A thermoelectric printer in accordance with claim 13, wherein:

said take-up diameter detector detects taken up sizes of the ink coated film at four or more places in the radial direction of the take-up diameter of the ink coated film.

16. A thermoelectric printer in accordance with claim 12, wherein:

said take-up diameter detecting means detects a near place of a maximum take-up radius, a center place of the maximum take-up radius, and a near place of said take-up shaft from the outside, in turn, in the radial direction of the take-up diameter of the ink coated film.

17. A thermoelectric printer in accordance with claim 12, wherein:

said take-up diameter detector detects taken up sizes of the ink coated film at four or more places in the radial direction of the take-up diameter of the ink coated film.

18. A thermoelectric printer in accordance with claim 10, wherein:

said take-up shaft takes up the ink coated film to a maximum take-up radius, and said take-up diameter detector detects the presence of the ink coated film in at least three places between an outside of said take-up shaft and the maximum take-up radius of the ink coated film in a radial direction.

* * * * *